United States Patent [19]

Berry et al.

[11] 4,102,288

[45] Jul. 25, 1978

[54] OPERATIONS VESSEL FOR ICE COVERED SEAS

[75] Inventors: Holland James Berry, Calgary, Canada; George W. Morgan, Houston, Tex.

[73] Assignee: Sun Oil Company Limited, Calgary, Canada

[21] Appl. No.: 772,787

[22] Filed: Feb. 28, 1977

[51] Int. Cl.[2] ..... B63B 35/08; B63B 35/12

[52] U.S. Cl. ..... 114/41; 61/103; 114/42; 114/264

[58] Field of Search ..... 114/40–42, 114/264, 265; 299/24, 25; 61/103, 1 R; 175/18

[56] References Cited

U.S. PATENT DOCUMENTS

| | | | |
|---|---|---|---|
| 3,669,052 | 6/1972 | Schirtzinger | 114/42 |
| 3,817,199 | 6/1974 | Schirtzinger | 114/42 |
| 3,868,920 | 3/1975 | Schirtzinger | 114/42 |
| 3,921,560 | 11/1975 | Schirtzinger | 114/41 |

*Primary Examiner*—Trygve M. Blix
*Assistant Examiner*—Stuart M. Goldstein
*Attorney, Agent, or Firm*—J. Edward Hess; Donald R. Johnson; James H. Phillips

[57] ABSTRACT

A mobile monopod operations platform for use in ice covered seas and adapted for carrying out two modes of ice disaggregation, either or both such modes being selectively useable during either transit or relatively stationary operations. An ice breaker bow is employed in conjunction with simulated pitching and heaving brought about by the programmed use of a plurality of fully vectorable thrusters on a submersible hull. At the stern of the monopod structure, counter-rotating cutting drums are utilized for ice disaggregation in a mode particularly useful when the ice is thick. Topside of the bow and cutter area, an enclosed, generally circular, superstructure is provided for carrying out the requisite operations while mitigating the adverse effects of high winds. The aforementioned fully vectorable thrusters are available to facilitate both movement of the platform to a select operational position and to maintain stability during the required operations as well as to simulate the pitching and heaving motions required for bow breaking of the ice sheet.

4 Claims, 7 Drawing Figures

OPERATIONS VESSEL FOR ICE COVERED SEAS

BACKGROUND OF THE INVENTION

The invention relates to an operations vessel for ice covered seas, and, more particularly, to a monopod structure having ice disaggregation system employing two fundametal modes of ice removal, each such ice removal mode being adapted for ice disaggregation in both a transit and operational phase of the vessel.

In the petroleum exploration and production industry it is often necessary to move and station men and equipment in relatively hostile environmental regions. In recent years the emphasis on oil production from the far north has necessitated development of new techniques for encountering formations of encroaching ice floes and the movements thereof which threaten the stability and/or position of equipment situated therearound.

In the Arctic, large offshore regions are often covered by thick layers of ice. Currently there is considerable activity in this and other frozen areas directed toward the location and development of sources of petroleum and other natural resources. The search for and production of these resources require operational platforms for locating equipment and personnel. These platforms are normally transported to their operational sites and maintained in a relatively fixed position with respect to the underwater floor by anchoring thereto and/or the utilization of dynamic positioning techniques. In the normal course of operation, pipes are extended from the platform into the earth's subsurface for the recovery of natural resources. It is then important to maintain the platform within a predetermined envelope in order to prevent breaking or withdrawing the pipe from the earth.

Platforms located in both shallow and deep covered waters are exposed to ice floes which sometimes float freely on the water. The ice may be comprised of such mass that a platform is susceptible to damage or destruction as a result of forces imparted thereagainst by the moving ice. The Arctic ocean, for example, is characterized by air temperature ranging from −70° to 70° F and ice sheets of thickness between 6 and 10 feet and pressure ridges of 10 to 100 feet. In such conditions, ice normally exhibits a compressive strength of 1000–3000 PSI and tensile strength of 300–1000 PSI. The problems of providing the requisite magnitude of force and power necessary for engagement with and disaggregation of such an environmental threat may be seen to be formidable.

One prior art approach to drilling platforms for ice covered seas has previously included a monopod, semi-submersible drilling platform design utilizing a single rotating cutter for ice floe engagement and disaggregation. The cutter is disposed between an upper superstructure comprising an operation platform and a submerged hull providing flotation. In this manner, only a relatively narrow profile emerges through encroaching ice layers while maximized platform surface area and buoyancy size parameters are met, respectively above and below the ice. This concept has been theoretically effective although a plurality of feasibility problems plague its realization. For example, a single rotating cutter capable of disaggregating such enormous masses of ice would produce a torquing about the submerged hull which would consume large quantities of fuel to counteract. Fuel must be stored aboard the platform which requires a storage area formed of heavy steel and iron, and this additional weight and bulk further increases the fuel requirements for moving the platform and stabilizing it above a borehole or within a predetermined envelope. Fuel necessary for counteracting torque may thus be equated to size and cost in a spiraling relationship. Size and cost are also primary factors in the transit phase of the platform operation and the problems related thereto have proven to be as formidable as the ability to stabilize the platform against ice movement.

It would be an advantage therefore, to overcome many of the disadvantages of prior art structures by providing an operations platform for ice covered seas adapted for transit movement therethrough and effective stabilization therein. The apparatus of the present invention is provided for just such a purpose wherein a monopod flotation structure is constructed with an intermediate hull comprising an ice breaking bow and ice disaggregating stern. The intermediate hull is similarly constructed for presenting a narrow profile to encountered ice floes. However, a pair of ice chipping and breaking drums are also provided for counter-rotation in order to disaggregate encroaching ice while in either the transit or operational mode. The paired configuration negates resultant torques. Moreover, the cutters are housed aft of a bow construction facilitating movement through both ice covered and open waters as is necessary for positioning of the platform above a selected functional operating region or in other operational modes as may be developed.

SUMMARY OF THE INVENTION

The invention relates to an operations vessel for multifunctional utilization on ice covered seas. One aspect of the invention includes a monopod, semi-submersible drilling vessel constructed with an ice breaking bow and aft ice disaggregation apparatus comprising an intermediate hull section. The bow is constructed in the form of a nautical wedge for facilitating transit operation in both open and ice laden waters and for breaking ice within its capability while in the operating mode. Additionally, the bow is adapted for ice breaking through pitching and heaving motion of the vessel imparted by a plurality of thrusters provided around a submersible flotation hull therebeneath. The thrusters are fully rotatable and programmed for complete thrust vector control. Atop the submersible and intermediate hulls, a deck structure is provided for housing vessel operations.

In another aspect, the invention includes a semi-submersible platform as set forth above wherein the deck structure is constructed with a generally circular outer configuration for eliminating wind direction sensitivity. The deck structure may also include an upstanding shrouded derrick for facilitating drilling operations wherein a moon pool is formed in and through the submersible hull therebeneath. In this manner the vessel may be moored or dynamically positioned at an operational site on an ocean floor and maintained thereabove in fixed position relative thereto. Encroaching ice floes which may threaten the stability of the vessel's fixed position may be broken up by the ice disaggregation apparatus provided aft the bow of the vessel and prepositioned for intercepting ice masses or, alternatively, by pre-positioning the bow of the vessel to intercept ice masses.

In yet another aspect, the invention includes a plurality of drums rotatably mounted in generally upstanding relationship relative to the submersible hull. The drums are comprised of an outer surface adapted for breaking, cutting and/or chipping particulate matter such as ice engaged thereby. In one embodiment, a pair of drums is mounted for counter-rotation wherein resultant reaction torque therefrom is cancelled. Jetting of compressed air or exhaust gasses from the vessel power generating system may be employed to clear cut ice from the rotating cutters. The drums may each include a plurality of outwardly extending spikes which, when the drum is rotated, engage the ice and break off portions thereof while delivering the same outwardly of the drums and the hull. The ice engagement and disaggregation of this construction also imparts a motive force to the stationary vessel in a direction opposite that of the encroaching ice floe. In this manner, threatening ice masses are both disaggregated and the impending force thereof partially offset by the disaggregation action. The thrusters of the submersible hull are constructed to provide compensational thrust for any force imbalance and the maintenance of the critical vessel position.

BRIEF DESCRIPTION OF THE DRAWINGS

For a more complete understanding of the present invention, and, for further objects and advantages thereof, reference may now be had to the following description taken in conjunction with the accompanying drawings, in which.

DETAILED DESCRIPTION

Figure 1:
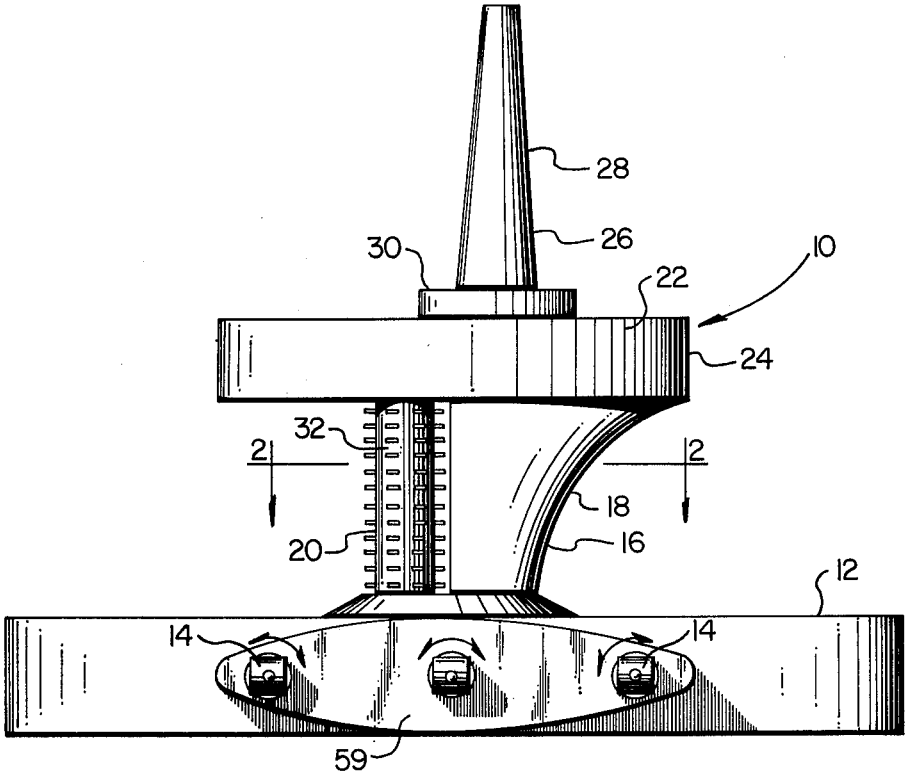
FIG. 1 is a side elevational view of one embodiment of an operations vessel for ice covered seas constructed in accordance with the principles of the present invention.

Referring first to FIG. 1, there is shown a side elevational view of an operations vessel for ice covered seas constructed in accordance with the principles of the present invention. The particular embodiment of the vessel shown herein is a semi-submersible, monopod type platform 10 for drilling, production, processing and/or storage and the like. The platform having a flotation hull section 12 adapted for submerged support and sustenance of the remaining vessel and also providing storage therefor. A plurality of propulsion units in the form of thrusters 14—14 are constructed around the flotation hull 12 for providing a transit mode of operation, dynamic positioning while in a stationary mode, and the capacity to engage ice floes in the positioning and operation thereof.

The platform 10 is constructed with an intermediate hull section 16 extending upwardly from the flotation hull 12 and includes a bow portion 18 and stern section 20 adapted for ice disaggregation. Atop the intermediate hull 16, a deck structure 22 is constructed for housing above-water operations. Deck 22 includes shrouded superstructure 24 from which a derrick 26 (or other producing, processing, or storage equipment) upstands. Derrick 26 includes a shroud 28 for safety and environmental protection and for decreasing wind drag forces. An operations area 30 therebelow is similarly provided in a shrouded configuration beneath and adjacent the derrick 26 for protecting platform personnel during platform operations. In the shrouded configuration shown herein, the topside profile of the platform 10 is substantially comprised of circular shapes which eliminate wind direction sensitivity and the disadvantages thereof.

Figure 2:
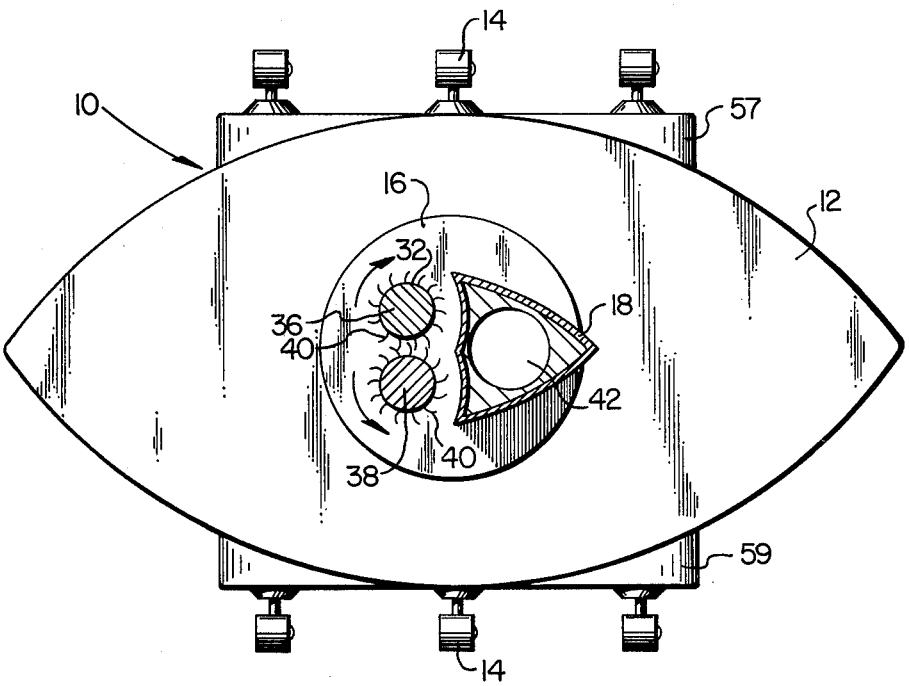
FIG. 2 is a top plan, cross-sectional view of the vessel of FIG. 1 taken along lines 2—2 thereof.

Referring now to FIG. 2, it may be seen that the flotation hull 12 of platform 10 is constructed for bidirectional movement in and through ice covered seas. The periphery of flotation hull 12 is therefore preferably comprised of an elliptical configuration which facilitates underwater movement and position stabilization. However, the constructional configuration providing the most improved operational efficiency is embodied in the intermediate hull 16. The top plan view of the drawing herein illustrates the provision of structural bow section 18 constructed in the shape of a nautical wedge. The term "nautical wedge" is utilized herein to include the generally tapered wedge configuration of the type commonly incorporated into the bow of relatively larger ships and particularly adapted for marine applications wherein ice is encountered. The bow 18 facilitates not only improved movement through water and more effective ice breaking operations in both the transit and positional modes, but also serves as a streamlined baffle for the stern section 20 whereat active ice disaggregation apparatus is employed.

It may be seen that the particular ice disaggregation apparatus 32 incorporated into the stern section 20 of the present embodiment, includes a pair of rotating drums 36 and 38, having spikes 40 outwardly extending therefrom. The spikes 40 are preferably constructed in the configuration of ice disaggregation teeth particularly adapted for cutting, chipping and/or breaking particulate matter such as ice. The spikes 40 may also be arranged in graduated lengths and/or in spaced arrays longitudinally along the drum for maximizing the ice disaggregation efficiency thereof. Compressed air, pumped sea water, preheated sea water or exhaust gasses may be employed to assist in removing cut ice from the ice-cutting surfaces of the rotating drums. Such spikes and drum configurations may be of the type shown and described in co-pending U.S. patent application Ser. No. 740,895, filed Nov. 11, 1976 and entitled "Method of and Apparatus for Disaggregating Particulate Matter". Of course, conventional spike arrays are also contemplated and are included within the spirit and scope of the invention as representedly illustrated in FIG. 1.

Still referring to FIG. 2, it may be seen that the drums 36 and 38 are adapted for counter-rotation. Drum 36 is therein shown to rotate clockwise, as illustrated, while drum 38 rotates counterclockwise. In this preferable construction, the commonly encountered problem of reaction torque applied to the vessel is eliminated. The cancellation of reaction torque negates the requisite actuation of thrusters 14—14 to counter the effect of drum rotation. It is particularly advantageous to eliminate reaction torque on the platform 10 when ice floes are of substantial size as will be discussed in more detail below. In the present embodiment, the thrusters can be fully utilized to counter the momentum of an engaged ice floe during disaggregation when the platform 10 is preferably fixedly positioned over the ocean floor for operation activity or during transit. The aperture, or moon pool 42, shown extending through the bow section 18, is provided for such operations wherein drilling, servicing or producing pipe is lowered and operated therethrough. The moon pool 42 is preferably shielded from the drums 36 and 38 and the engaged ice floe itself, as shown, to prevent broken sections of ice from hampering drilling, servicing, or producing operations.

Figure 3:
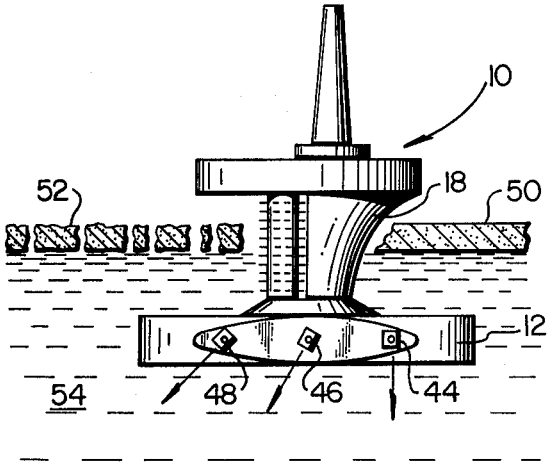
FIG. 3 is a side elevational view of the vessel of FIG. 1 shown positioned in ice covered seas and illustrating one step in a method of advancing through an ice floe or maintaining position at an operational site by the use of thrusters positioned around a submerged portion of the vessel.
Figure 4:
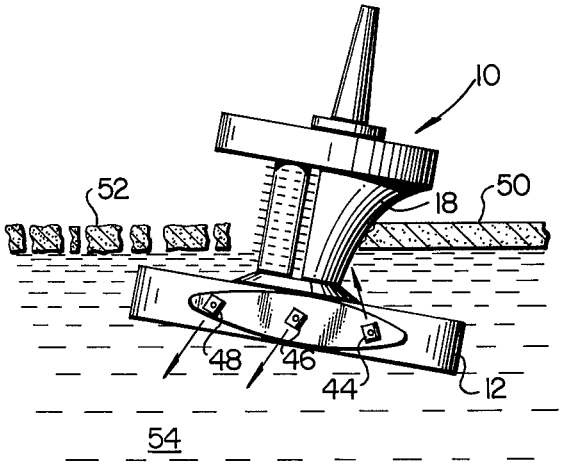
FIG. 4 is a side elevational view of the vessel of FIG. 3 therein illustrating a second step in the method initiated in FIG. 3 of advancing through an ice floe or maintaining position at an operational site in accordance with the principles of the present invention.
Figure 5:
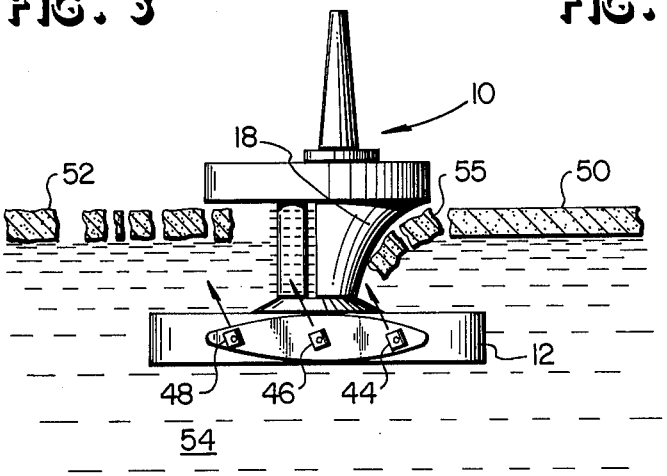
FIG. 5 is a side elevational view of the vessel of FIG. 3 therein illustrating a third step in the method initiated in FIG. 3 of advancing through an ice floe or maintaining position at an operational site.

Referring now to FIGS. 3, 4, and 5, in combination, the ice disaggregation capacity of the platform 10 is illustrated in the transit mode of operation as is generally necessary when moving operational platforms to pre-selected sites. Such preliminary operations are herein facilitated by the streamlined bow 18 which reduced resistance to movement. The platform 10 is thus capable of independent transit operation rather than depending on conventional tow techniques commonly utilized for drilling, producing, processing or storage platforms. Similarly, a separate ice breaking vessel is not needed for movement in frozen, or ice laden, waters. Although ice breaking vessels are generally capable of pitching and heaving a greater mass than may be functionally feasible with drilling, producing, processing or storage platforms, the platform 10 of the present invention is adapted to emulate motions of a heavier surface craft by utilizing the weight of the platform 10 and thrusters 14—14 in a pre-programmed manner.

As shown most clearly in FIG. 3, the platform 10 is shown to be semi-submerged in a body of water 54 adjacent an unbroken floe of ice 50. Progress through the ice 50 or maintenance of a position is effected by ice breaking, pitching and heaving of the platform 10 and particularly bow 18 to break up the ice into broken sections 52. This motion is created by utilization of a frontal thruster 44 on the starboard side and an equivalent thruster (not shown) on the port side which propel water downwardly to lift the bow 18 upwardly. Intermediate thruster 46 and rear thruster 48 simultaneously propel the platform forward, as illustrated in the thrust vector array of arrows in this Figure. This first phase of transit ice disaggregation positions a large section of the bow 18 of the platform 10 above the unbroken ice layer 50.

The platform 10 is illustrated in a second phase of ice disaggregation in FIG. 4, wherein the frontal thruster 44 has been rotated to drive the bow 18 into the ice 50. FIG. 5 illustrates the programmed result of this operation as broken sections of ice 55 are shown to be carried downwardly under the combined weight of the platform 10 and propulsion of re-oriented thrusters 46 and 48. It may be seen that the indivudal thrusters 14 are employed to effect the motion of a much larger vessel by utilizing active propulsion in place of passive mass. In this manner, the thrusters 14 function in a dual capacity by both propelling the platform 10 (or actively maintaining it on location) and imparting motion characteristics thereto indicative of a different type of craft.

The transit mode of operation illustrated in FIGS. 3, 4, and 5 is the result of pre-programmed force vector control provided through the utilization of thrusters 14 on both sides of the platform 10. The positioning of each thruster 14 is therefore one parameter which must be taken into consideration in construction. The thrusters 14 are shown to be provided about the generally elliptical flotation hull 12, through peripheral support bulk heads 57 and 59 which are constructed on opposite longitudinal sides of the flotation hull. This configuration allows the thrusters 14 to rotate about horizontal axes which are parallel to one another. Such an array facilitates complete thruster vector control as required for both transit operation and dynamic positioning in the operational mode of operation.

Figure 6:
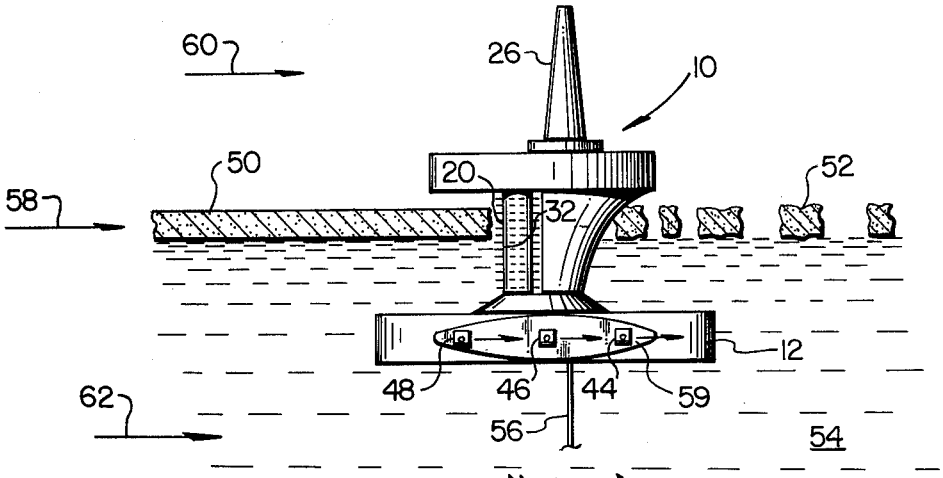
FIG. 6 is a side elevational view of the vessel of FIG. 1 shown positioned in ice covered seas in an operational configuration and illustrating the utilization of ice disaggregation apparatus provided therewith for maintaining fixed relative positioning against an encroaching ice floe in accordance with the principles of the present invention.

Referring now to FIG. 6, the platform 10 is illustrated in an operational mode. In this figure, the direction of current flow and ice movement is shown by an arrow in water 54. The thrusters 44, 46 and 48 are thus oriented to counter the force of these masses. In addition the ice cutting apparatus 32 is positioned to engage the encroaching ice 50 and disaggregate it into smaller section 52 by passing it around the bow 18. In this manner, a drill, producing, or servicing pipe 56 may be driven into the ocean floor below while platform 10 maintains its position through thruster programming. In the event the ice floe freezes to the bow 18 in times of relative inactivity, the method of bow ice breaking outlined above may be utilized. An additional pair of thrusters (not shown) positioned fore and aft of submerged hull 12 would also maximize upward thrust capabilities as well as facilitating platform stabilization against side wind loading.

Figure 7:
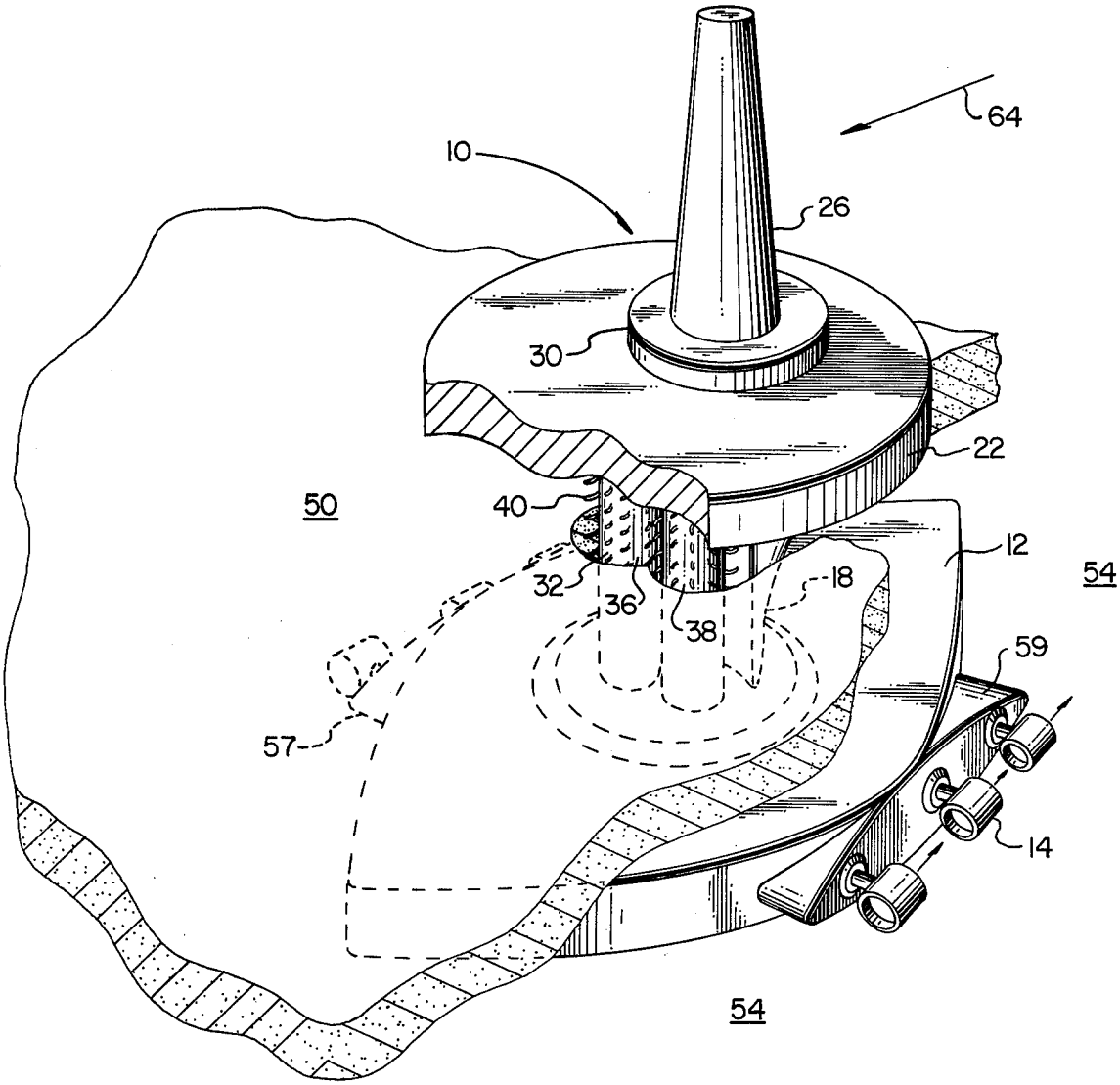
FIG. 7 is a partially cut away three-quarter view of the vessel of FIG. 1 illustrating a method of advancing relatively, through an ice floe by the utilization of the ice disaggregation apparatus provided therewith and by the use of the vessel thrusters positioned around a submerged portion of the vessel.

Referring now to FIG. 7, the platform 10 is shown advancing in a transit mode through the ice sheet 50. It will be observed that the counter-rotating cutters 36, 38 disaggregate the ice sheet in order to permit relative movement (indicated by the arrow 64) between the ice sheet 50 and the platform 10 in a direction generally governed by the orientation of the thrusters 14.

The construction of platform 10 necessitates a massive structural interconnection between deck 22 and flotation hull 12. This substructure (not shown) is preferably provided within the bow 18 and through the centers of drums 32 and 38. Since monopod drilling producing, processing and platforms are not in themselves totally novel, the contructional parameters of interconnection are recognized to be conventional. In like manner, it is of conventional design to utilize a portion of the flotation hull 12 as a storage area for fuel, bulk drilling consumable (such as water and drilling mud), power sources, electric motors, etc., and in the case of a production, processing or storage vessel, for the storage of processed or unprocessed hydrocarbons or minerals. Enormous quantities of fuel are inherently necessary for self-contained operational platforms as is necessary herein to power the drums 36 and 38 and thrusters 14. The type of thruster 14 may, of course, vary according to the overall approach to the platform 10, but each thruster, of whatever type, is preferably capable of full 360° rotation around its mounting axis. In this manner, the dynamic positioning capability of the monopod structure facilitates the transit or positional ice breaking mode of operation totally unlike conventional operational platforms. In addition, the hot exhaust gases from the vessel power generating system may be employed as one means to keep the waters free of chipped ice to keep the ice cutters free of ice, and/or to assist in decreasing the ice friction along the surface of the bow 16.

It is believed that the operation and construction of the invention will be apparent from the foregoing description. While the method and apparatus thereof shown and described has been characterized as being preferred, it will be obvious that various changes and modifications may be made therein without departing from the spirit and scope of the present invention.

What is claimed is:

1. An improved monopod operations platform for ice covered seas of the type having a deck structure atop an intermediate hull upstanding from a submersible flotation hull, wherein the improvement comprises said intermediate hull having a bow region constructed in the form of a nautical wedge and a stern section adapted for ice disaggregation in both a transit and non-transit mode, said stern section including a pair of ice disaggregating drums mounted for counter-rotation in a generally parallel relationship for eliminating resultant reaction torque therefrom, said improvement further comprising a plurality of fully vectorable thrusters provided around the submersible hull, said thrusters being adapted for rotation about generally horizontal axes for obtaining programmable thrust vector control.

2. The operations platform of claim 1 wherein said submersible flotation hull is generally elliptically-shaped to facilitate transit in both fore and aft directions.

3. The operations platform of claim 1 wherein the improvement further comprises a deck structure constructed with a generally circular outer configuration for eliminating wind direction sensitivity.

4. The operations platform of claim 1 wherein the improvement further comprises a moon pool constructed in the submersible hull for providing access to the floor of the seas.

* * * * *